US005423369A

United States Patent [19]

Ota et al.

[11] Patent Number: 5,423,369

[45] Date of Patent: Jun. 13, 1995

[54] APPARATUS FOR AND METHOD OF VACUUM CASTING

[75] Inventors: Atsushi Ota, Toyota; Minoru Uozumi; Shigeki Tamura, both of Aichi; Hirokazu Onishi, Toyota; Yasuyuki Arakawa, Nagoya, all of Japan

[73] Assignee: Toyota Jidosha Kabushiki Kaisha, Japan

[21] Appl. No.: 75,555

[22] PCT Filed: Oct. 26, 1992

[86] PCT No.: PCT/JP92/01387

§ 371 Date: Jun. 24, 1993

§ 102(e) Date: Jun. 24, 1993

[87] PCT Pub. No.: WO/9307977

PCT Pub. Date: Apr. 29, 1993

[30] Foreign Application Priority Data

Oct. 25, 1991 [JP] Japan ..... 3-306999
Oct. 30, 1991 [JP] Japan ..... 3-311674

[51] Int. Cl.[6] ..... B22D 17/12; B22D 18/02; B22D 18/06

[52] U.S. Cl. ..... 164/63; 164/119; 164/120; 164/254; 164/306

[58] Field of Search ..... 164/63, 119, 120, 254, 164/306, 309

[56] References Cited

FOREIGN PATENT DOCUMENTS

| | | | |
|---|---|---|---|
| 56-121069 | 8/1981 | Japan . | |
| 61-27162 | 2/1986 | Japan . | |
| 61-182868 | 8/1986 | Japan . | |
| 63-163249 | 10/1988 | Japan . | |
| 2-155557 | 6/1990 | Japan . | |
| 3-31058 | 3/1991 | Japan . | |
| 3-68955 | 7/1991 | Japan . | |
| 3-198969 | 8/1991 | Japan | 164/306 |
| 4-158968 | 6/1992 | Japan . | |

*Primary Examiner*—J. Reed Batten, Jr.
*Attorney, Agent, or Firm*—Finnegan, Henderson, Farabow, Garrett & Dunner

[57] ABSTRACT

In a method of vacuum casting molten metal sucked from a molten metal reservoir into a cavity held under a reduced pressure by opening a gate having been blocking the communication between the molten metal reservoir and the cavity, the trapping of gas and foreign matter in the cavity is effectively prevented. To this end, an accommodation space for accommodating gas and foreign matter is provided in the molten metal reservoir. The accommodation space is provided at a position from which the accommodated matter is not sucked into the cavity.

4 Claims, 13 Drawing Sheets

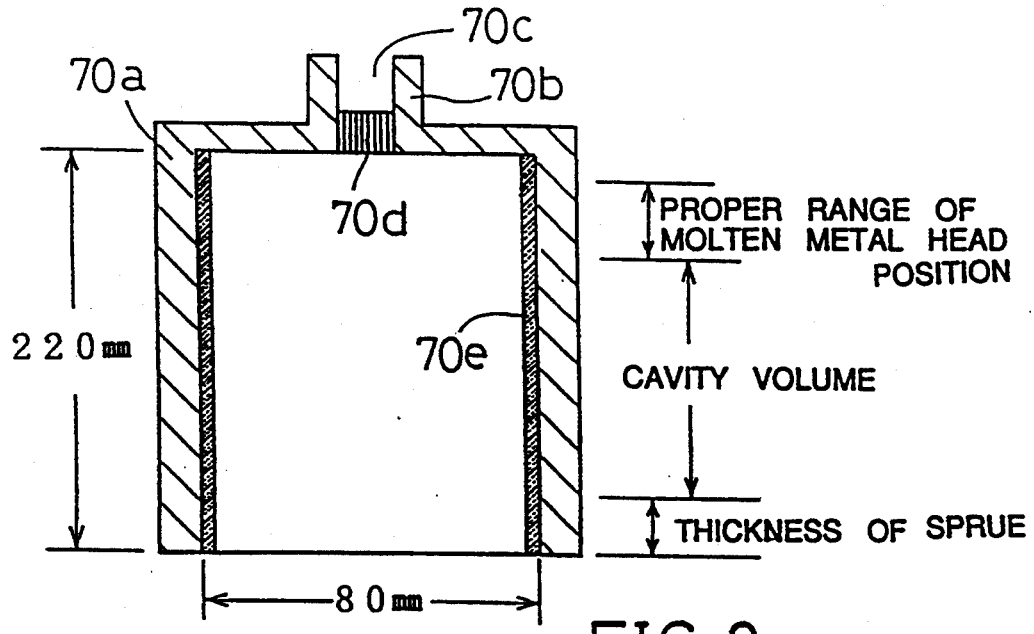
FIG. 2
FIG. 3(A)
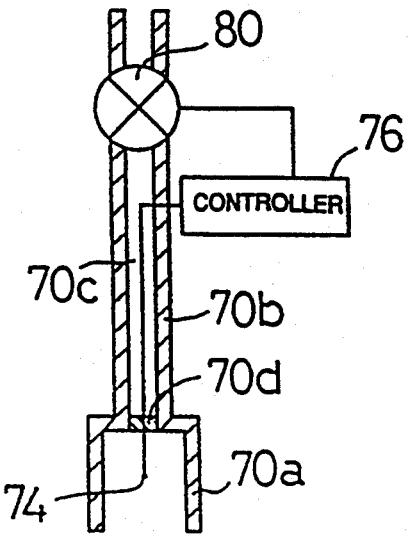
FIG. 3(B)
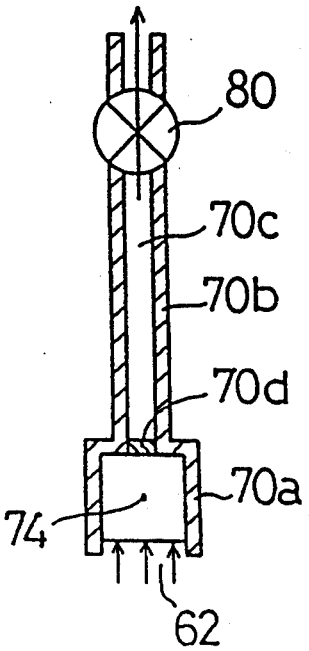
FIG. 3(C)
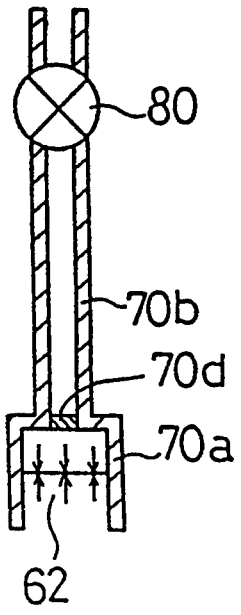

APPARATUS FOR AND METHOD OF VACUUM CASTING

TECHNICAL FIELD

This invention relates to a method of casting molten metal sucked from a molten metal reservoir into a cavity held under a reduced pressure by opening a gate having been blocking the communication between the molten metal reservoir and the cavity (hereinafter referred to as method of vacuum casting) and an apparatus for carrying out this method.

BACKGROUND ART

The vacuum casting can suppress the trapping of air in molten metal and this permits obtaining high quality casting with less casting defects such as cavity blanks, blowholes and microporocity. An example of the apparatus to this end is disclosed in Japanese Laid-Open Utility Model Publication No. 3-31058. FIG. 18 shows the apparatus disclosed in the publication.

This apparatus comprises a cavity 2 formed in a casting die 1 and a vacuum pump 4 for reducing the pressure in the cavity 2. The cavity 2 can communicate with a molten metal tank 8, in which molten metal 6 is stored, via a molten metal passage 10. At a sprue 2*a* of the cavity 2, a gate mechanism 12 is provided for on-off switching the communication between the molten metal passage 10 and the cavity 2. The gate mechanism 12 has an internal axial passage 12*b* communicated with a pressure reducing pump 20. The passage 12*b* has an end communicating with the molten metal passage 10 via a vent 12*a* at a position closer to the molten metal tank 8 than the gate mechanism 12 is.

A molten metal reservoir 14 having a predetermined volume is provided in an intermediate portion of the molten metal passage 10 located to be closer to the molten metal tank 8 than the gate mechanism 12 does.

In this casting apparatus, molten metal is introduced into the cavity 2 in the following way.

First, in a state with the sprue 2*a* held closed by the gate mechanism 12, the pressure in the cavity 2 is reduced by operating the vacuum pump 4. At this time, the pressure reducing pump 20 is also operated to produce a negative pressure in the molten metal reservoir 14 and molten metal passage 10, thus causing molten metal 6 stored in the molten metal tank 8 to be sucked up to the position of the end of the gate mechanism 12. That is, the molten metal 6 is tentatively stored in the molten metal reservoir 14 and molten metal passage 10.

In this state, the gate mechanism 12 is opened, causing the molten metal 6 stored in the molten metal reservoir 14 and molten metal passage 10 to be sucked and fill the cavity 2.

SUMMARY OF THE INVENTION

In the above prior art casting apparatus, however, the level (or height) of the top of the molten metal reservoir 14 is lower than the level of the opening/closing position of the gate mechanism 12. Therefore, as the molten metal 6 having been stored in the molten metal reservoir 14 and molten metal passage 10 is sucked quickly into the cavity 2, gas and foreign matter which have been floating in an upper portion of the molten metal reservoir 14 are carried along with the molten metal 6 into the cavity 2. Gas which is once sucked into the cavity 2 can not be removed even by bringing about a high vacuum state of the cavity 2 and thus causes defective product.

The present invention is predicated in the development of a technique of preventing gas and foreign matter floating in the molten metal reservoir from being sucked into the cavity when molten metal is sucked thereinto.

In the casting apparatus according to the invention, an accommodation space is provided, which can accommodate gas and foreign matter floating atop molten metal stored in the molten metal reservoir. This accommodation space is located at a position from which any matter accommodated in the accommodation space is unable to enter the cavity. The provision of this accommodation space has an effect of effectively suppressing the suction of gas or foreign matter into the cavity.

In a first mode of the invention, the molten metal reservoir is formed in the molten metal passage by making the volume of a portion of the molten metal passage located above the height (or level) of a position at which the cavity is opened and closed by the gate means, to be greater than the volume of the cavity. With this arrangement, an upper portion of the molten metal reservoir constitutes the accommodation space to accommodate gas and foreign matter, thus effectively suppressing the suction of gas and foreign matter into the cavity.

In a second mode of the invention, the molten metal passage is partly constituted by cylinder, in which a first and a second piston are slidably accommodated. The first piston serves as a gate piston for on-off switching the communication between the cavity and the molten metal passage. Further, a branch passage branching from the cylinder is formed during a stroke of the second piston. Even when the second piston moves as close as possible to the first piston, the volume between the two pistons is greater than the volume of the casting die cavity.

With this arrangement, by bringing the second piston closer to the first piston with the gate held closed thereby, the molten metal stored in the cylinder is pressurized, causing gas or foreign matter to be discharged into the branch passage. By subsequently further bringing the second piston closer, the communication between the cylinder and the branch passage is blocked to prohibit re-entrance of the gas or foreign matter. In consequence, molten metal free from gas or foreign matter is tentatively stored in the space between the first and second pistons (this space constituting the molten metal reservoir). By opening the gate in this state, no gas or foreign matter is sucked into the cavity, and thus it is possible to obtain a high quality casting.

With the above casting apparatus, while molten metal is stored in the molten metal reservoir, a step of accommodating gas or foreign matter in the accommodation space located at a position from which the gas or foreign matter is not sucked into the cavity, is executed before molten metal is sucked into the cavity. By this method, it is thus possible to effectively suppress the suction of gas or foreign matter into the cavity.

BRIEF DESCRIPTION OF THE DRAWINGS

FIG. 2 is an enlarged sectional view of a gate tip used in the casting apparatus of the first embodiment;

FIGS. 3(A) to 3(C) are schematic views of a molten metal feeder mechanism used in the casting appratus of the first embodiment;

BEST MODE OF CARRYING OUT THE INVENTION

Now, a first embodiment of the invention will be described with reference to the accompanying drawings.

Figure 1:
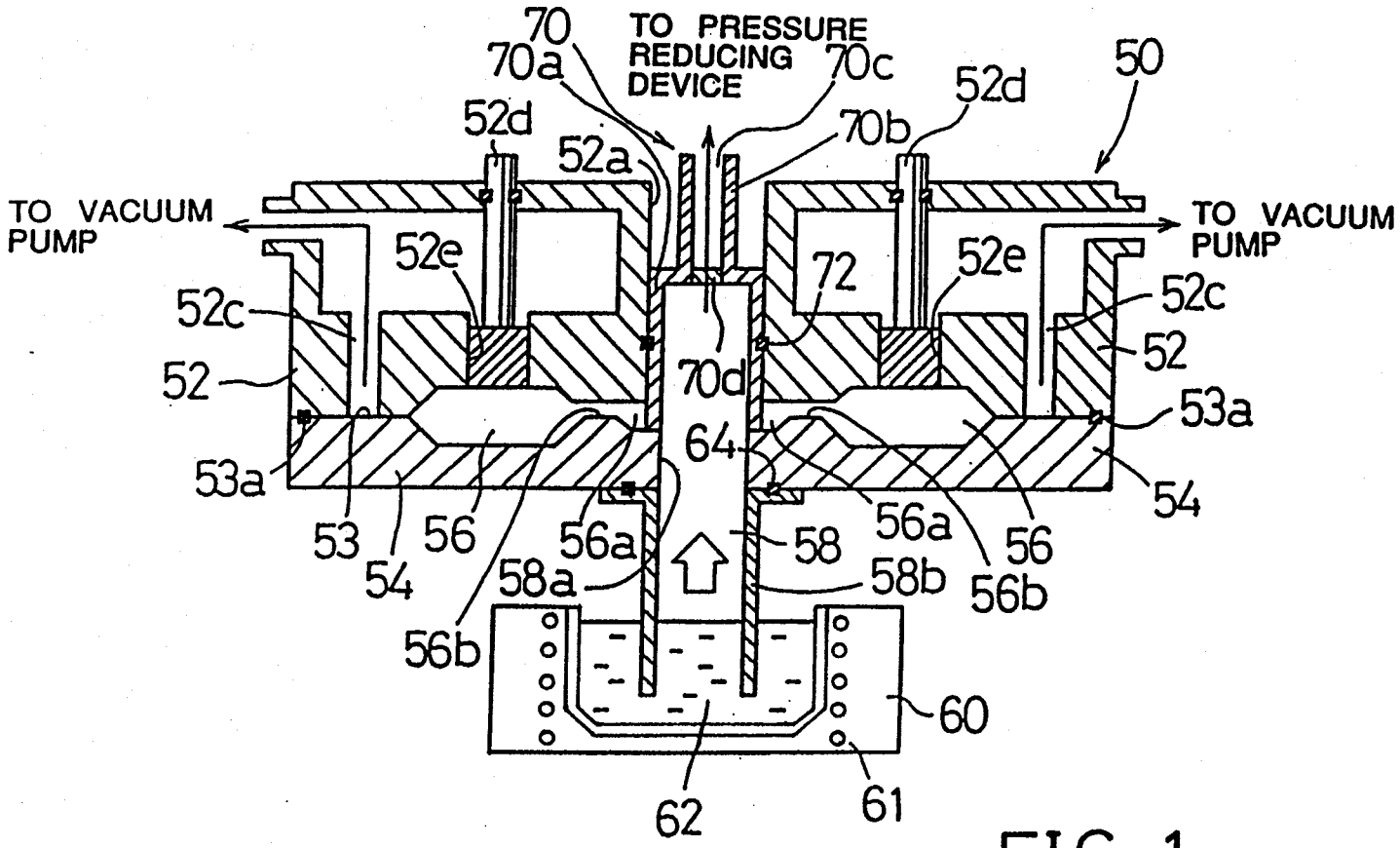
FIG. 1 is a sectional view of the essential parts of a casting apparatus according to a first embodiment of the invention.

FIG. 1 is a sectional view of the essential parts of a casting apparatus according to the embodiment. This casting apparatus comprises a casting die 50 which comprises an upper die 52 and a lower die 54. In the casting die 50, a central cavity 56 is formed when the upper and lower dies 52 and 54 are engaged. The cavity 56 has a central sprue **56*a* formed via a dam portion 56*b*. At the sprue 56*a*, the cavity 56 is communicated with a molten metal passage 58**.

The molten metal passage 58 is constituted by a passage **58*a* formed in the center of the lower die 54 and a cylindrical stalk 58*b* connected to the lower surface of the lower die 54 in such a manner as to be communicated with the passage 58*a*. During casting, the free end of the stalk 58*b* is immersed in a molten aluminum alloy 62 (hereinafter referred to as molten metal 62) stored in a melting furnace 60. An O-ring 64 made of heat-resistant rubber is provided between the engaged surfaces of the lower die 54 and the stalk 58*b* to ensure airtightness of the molten metal passage 58. The melting furnace 60 serves as a molten metal tank to store molten metal. Designated at 61** is a heater for thermally melting metal.

A gate mechanism 70 for opening and closing the sprue **56*a* of the cavity 56 is provided at the interface between the sprue 56*a* and the molten metal passage 58. The gate mechanism 70 includes a cylindrical gate tip 70*a* closed at the top and a hollow coupling member 70*b* coupling the gate tip 70*a*** and a moving mechanism (not shown).

The gate tip **70*a* is accommodated in a central axial hole 52*a* formed in the upper die 52 such that it is substantially in close contact with the wall surface of the hole 52*a*. The gate tip 70*a* can be displaced vertically through the hole 52*a*** when the moving mechanism is operated.

When the gate tip **70*a* is lowered upon operation of the moving mechanism to bring its end face into contact with the surface of the lower die 54, the sprue 56*a* of the cavity 56 is closed by the outer surface of the gate tip 70*a*. At this time, the inner space in the gate tip 70*a* is communicated with the molten metal passage 58**.

When the gate tip **70*a* is raised so that its end face is separated from the surface of the lower die 54, the sprue 56*a* of the cavity 56 is opened. As a result, the inner space in the gate tip 70*a* is communicated with both the molten metal passage 58 and cavity 56. An O-ring 72 made of heat-resistant rubber is provided between the outer surface of the gate tip 70*a* and the inner wall surface of the hole 52*a* of the upper die 52 to prevent deterioration of the seal due to vertical frictional movement of the gate tip 70*a***.

As shown in the enlarged sectional view of FIG. 2, the gate tip **70*a* has a heat insulation layer 70*e*, which is formed by spraying a ceramic material onto the inner wall surface of its cylindrical part (with an inner diameter of 80 mm and a height of 220 mm). Its top ceiling has a central sintered vent 70*d*, which does not pass the molten metal 62** but passes gas only.

To the center of the top surface (i.e., ceiling surface) of the gate tip **70*a* is connected the lower end of the cylindrical coupling member 70*b* coupling the gate tip 70*a* to the moving mechanism noted above. The pin 70*b*, as shown in FIGS. 2 and 3, is coaxial with the gate tip 70*a* and has an inner axial exhaust passage 70*c*. The lower end of the exhaust passage 70*c* is communicated with the interior of the gate tip 70*a* via the permeable sintered vent 70*d*. The upper end of the exhaust passage 70*c* is connected to a pressure reducing unit (not shown). When the pressure reducing unit is driven while the sprue 56*a* of the cavity 56 is closed by the gate tip 70*a*, a negative pressure is produced in the molten metal passage 58, causing the molten metal 62 stored in the melting furnace 60 to be sucked through the stalk 58*b* into the gate tip 70*a*. The extent of reduction of the pressure in the stalk 58*b*** is set to about 400 mm Hg ($5.332\times10^4$ Pa).

Inside the gate tip **70*a* a molten metal temperature sensor 74 is disposed at a predetermined position, as shown in FIG. 3(A). The output signal of the molten metal temperature sensor 74 is inputted to a controller 76. In the controller 76, the temperature detected by the molten metal temperature sensor 74 is compared to a reference temperature (which is set to be lower than the molten metal temperature). If the detected temperature is above the reference temperature, it is judged that the molten metal 62 has reached the position of the molten metal temperature sensor 74. When the position of the molten metal temperature sensor 74 is reached by the molten metal 62, the controller 76 outputs a signal for closing a valve 80 provided on the exhaust passage 70c. When the exhaust passage 70c is closed by the valve 80, the suction of the molten metal 62 through the stalk 58b is stopped even if the pressure reducing unit is operative, and thus the level of the molten metal in the gate tip 70a is held at the position of the molten metal temperature sensor 74** as shown in FIG. 3(C).

The position of the molten metal temperature sensor 74 is set such that the heat of molten metal comes to be in a proper range of molten metal head position as shown in FIG. 2. The proper range of molten metal head position is such that the molten metal 62 stored in the gate tip 70a does not contact the sintered vent 70d and also that the molten metal 62 in excess of the amount to be charged into the cavity 56 can be stored at a level higher than that of the cavity 56. More exactly, a volume in excess of the cavity volume is secured at a level higher than the level of the upper end of the sprue 56a opened and closed by the gate mechanism 70.

Figure 8:
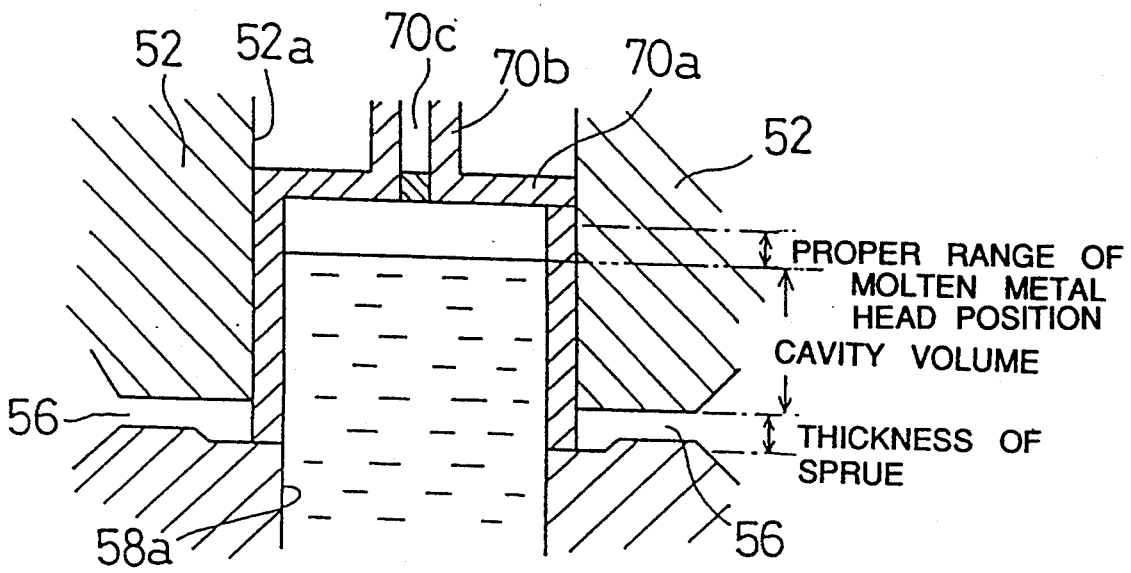
FIG. 8 is a fragmentary sectional view illustrating the level (or height) relation between the cavity and the gate tip.

With the molten metal head level thus held in the proper range, the molten metal 62 does not contact the sintered vent 70d, and thus there is no possibility of clogging of the sintered vent 70d. This status of the inside of the gate tip 70a is illustrated in FIG. 8.

It is to be appreciated that the inner space of the gate tip 70a serves as a molten metal reservoir and that the exhaust passage 70c , pressure reducing unit, molten metal temperature sensor 74, controller 76 and valve 80 constitute a molten metal supply mechanism for supplying molten metal to the molten metal reservoir.

In the molten metal supply mechanism of this embodiment, the molten metal 62 is supplied by suction to the gate tip 70a. However, this is by no means limitative, and it is possible to pressurize the molten metal 62 in the melting furnace 60 and supply it to the inner space of the gate tip 70a, as will be described in detail in connection with a second embodiment.

As shown in FIG. 1, the cavity 56 is communicated with a pressure reduction passage 52c formed in the upper die 52 via a gap 53 formed between the engagement surfaces of the upper and lower dies 52 and 54. The pressure reduction passage 52c is connected to a vacuum pump (not shown). An O-ring 53a made of a heat-resistant rubber is provided between the engagement surfaces of the upper and lower dies 52 and 54 adjacent the edge thereof to ensure airtightness between the cavity 56 and the outside of the casting die 50.

With this arrangement, when the vacuum pump is operated with the sprue 56a held closed by the gate mechanism 70, the pressure in the cavity 56 is reduced down to a predetermined pressure (below 20 Torr ($2.666\times10^3$ Pa)).

Above the cavity 56, a pressurizing piston 52d is provided to pressurize the molten metal 62 charged in the cavity 56. The pressurizing piston 52d is capable of vertically sliding along a cylinder 52e formed in the upper die 52, and it is operated by a piston drive mechanism (not shown). The pressure applied by the pressurizing piston 52d is set to 200 to 1,000 kg/cm$^2$ ($1.96\times10^7$ to $9.8\times10^7$ Pa).

The pressure reduction passage 52c and the vacuum pump constitute pressure reducing means for reducing the pressure in the cavity.

The operation of this casting apparatus will now be described with reference to FIGS. 4 to 8.

Figure 4:
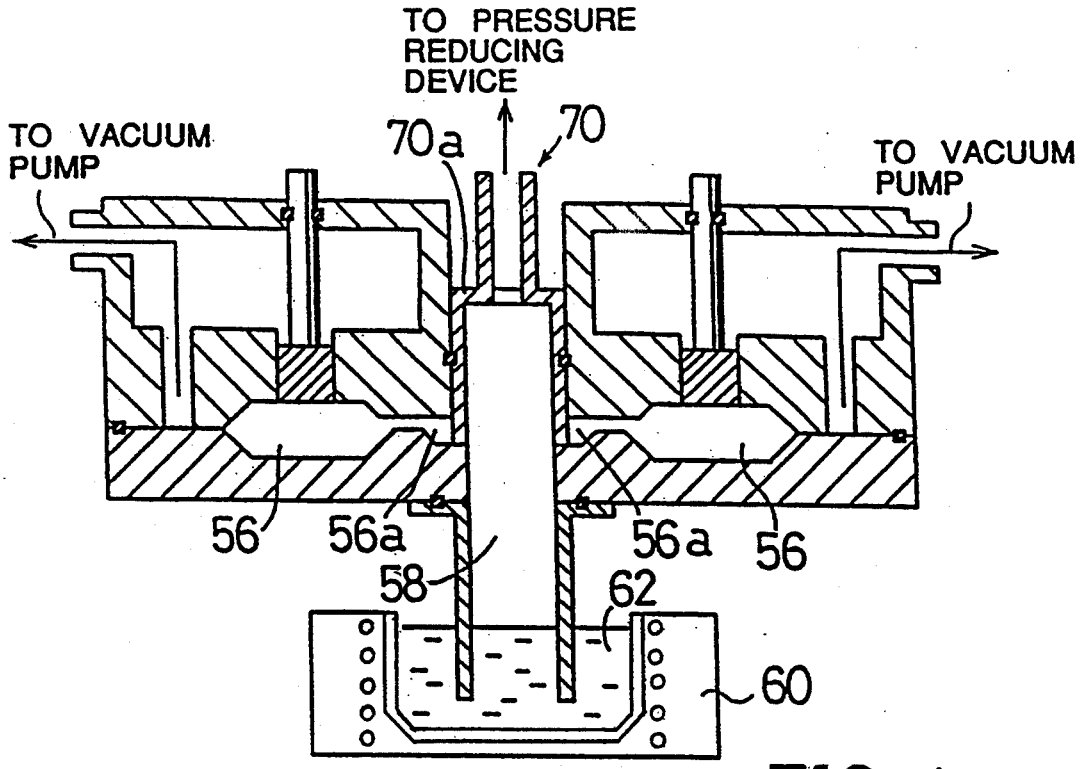
FIG. 4 is a sectional view illustrating the operation of the casting apparatus of the first embodiment.
Figure 5:
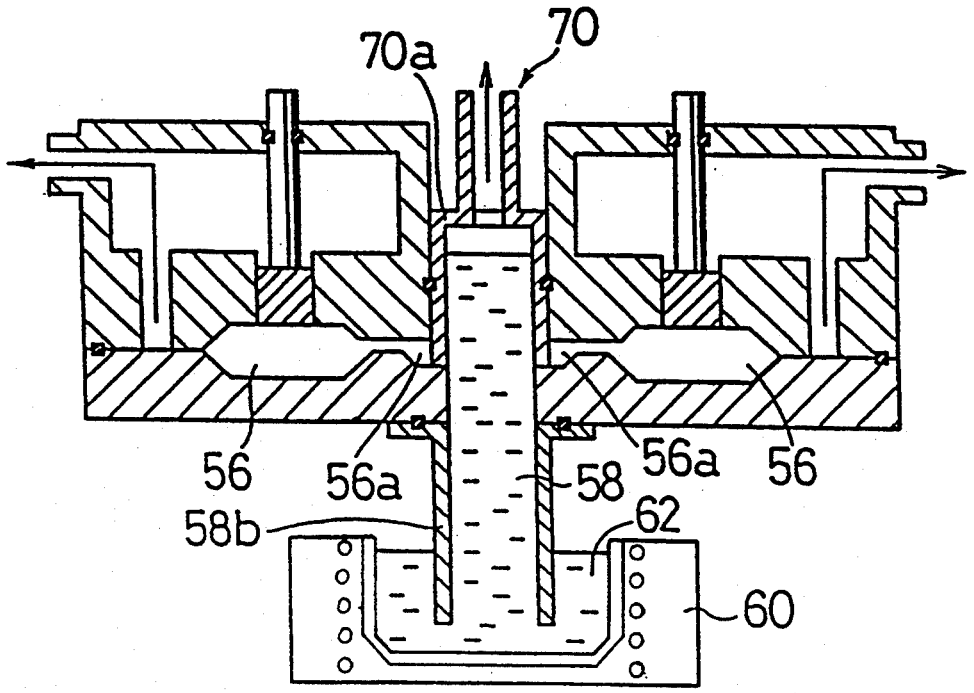
FIG. 5 is a sectional view illustrating the operation of the casting apparatus of the first embodiment.

First, in a state shown in FIG. 4, with the sprue 56a of the cavity 56 held closed by the the gate mechanism 70, the vacuum pump is operated to reduce the pressure in the cavity 56.

Meanwhile, the pressure reduction unit is operated to reduce the pressure in the molten metal passage 58 and the gate tip 70a, thus causing the molten metal 62 stored in the melting furnace 60 to be sucked through the stalk 58b into the gate tip 70a. At this time, the molten metal temperature sensor 74, controller 76 and valve 80 are operated to hold the head level of the molten metal 62 sucked into the gate tip 70a in the proper range as noted above. That is, the molten metal 62 stored in the gate tip 70a doesnot contact the sintered vent 70d, and the molten metal 62 in excess of the amount to be charged into the cavity 56 is stored at a level higher than the level of the cavity 56 (more accurately the height of the upper end of the sprue 56a).

Figure 6:
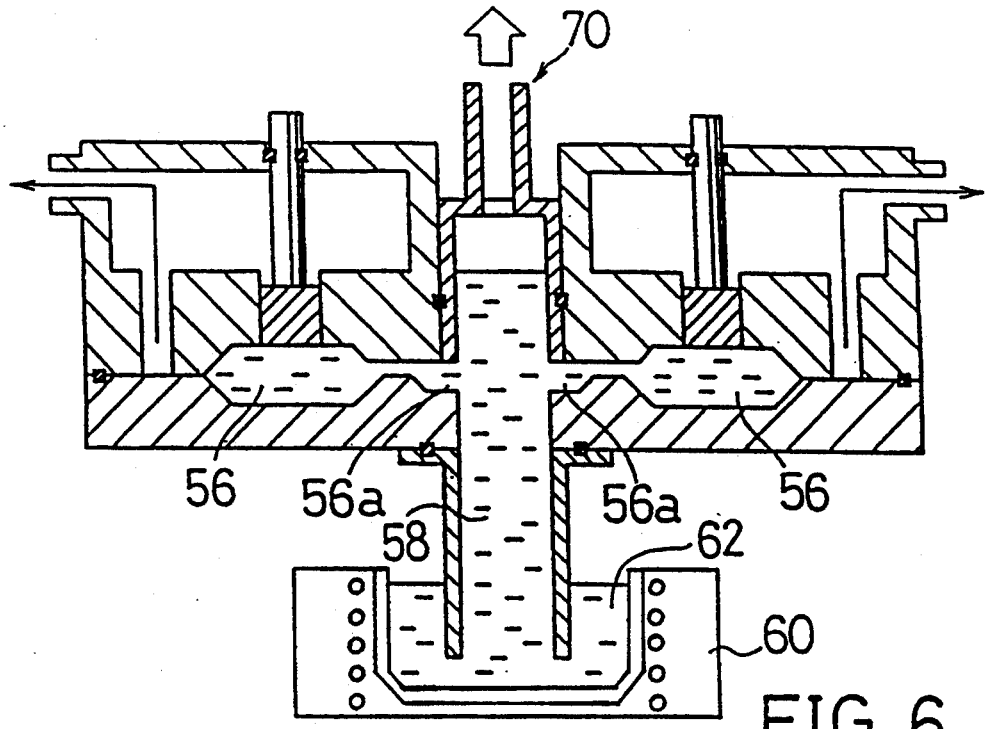
FIG. 6 is a sectional view illustrating the operation of the casting apparatus of the first embodiment.

In this state, the gate mechanism 70 is then raised to open the sprue 56a of the cavity 56, as shown in FIG. 6, thus causing the molten metal 62 having been stored in the molten metal passage 58 and the gate tip 70a to be sucked quickly into the cavity 56.

If the molten metal is sucked slowly into the cavity 56 at this time, the molten metal head in the gate tip 70a is not substantially lowered because the molten metal supplied to the cavity 56 is sucked from the melting furnace 60 through the stalk 58b. However, when the molten metal is sucked quickly as in the casting apparatus of this embodiment, the amount of molten metal fed through the molten metal passage 58 is insufficient. This insufficiency is made up for by the molten metal stored in the gate tip 70a. Therefore, the molten metal head in the gate tip 70a is lowered. However, the molten metal 62 in excess of the amount to be charged into the cavity 56 is stored in a portion of the gate tip 70a higher in level than the suprue 56a of the cavity 56. For this reason, when the molten metal stored in the gate tip 70a is supplied to the cavity 56, the molten metal head in the gate tip 70a does not become lower than the sprue 56a of the cavity 56.

Thus, even when the molten metal 62 is sucked quickly into the cavity 56, gas floating above or foreign matter floating on the molten metal head in the gate tip 70a is not sucked into the cavity 56. In other words, in this embodiment an upper space in the gate tip 70a serves as an accommodation space to accommodate the gas or foreign matter, and the accommodated gas or foreign matter is,not sucked into the cavity 56.

Figure 7:
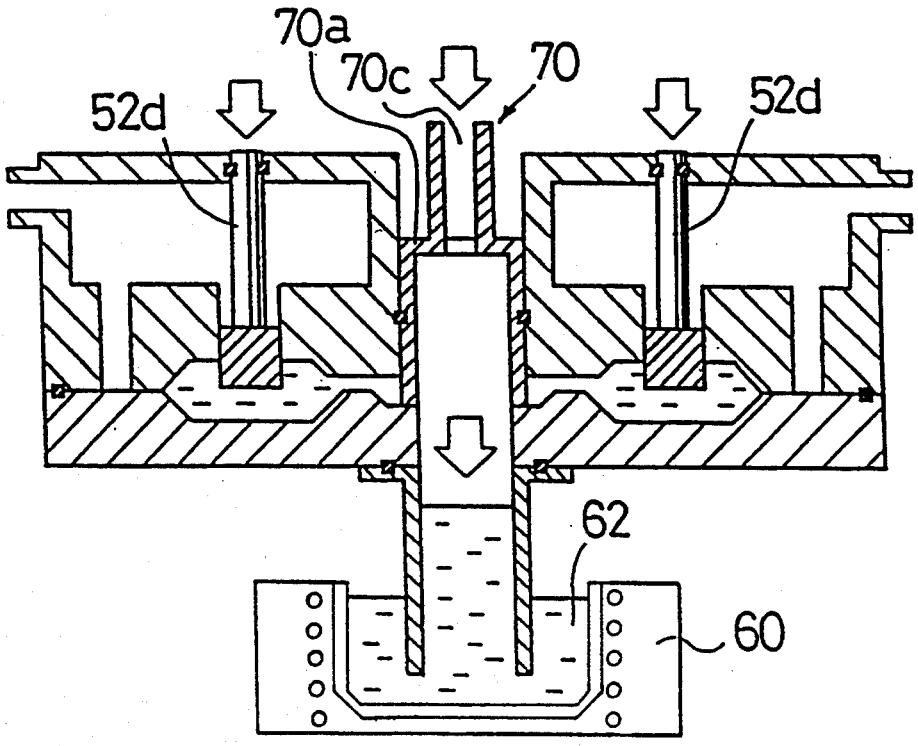
FIG. 7 is a sectional view illustrating the operation of the casting apparatus of the first embodiment.

When the cavity 56 is filled with the molten metal 62 in this way, the gate mechanism 70 is lowered to close the sprue 56a of the cavity 56 again, as shown in FIG. 7. Then, the molten metal 62 in the cavity 56 is pressurized with a predetermined pressure by the pressurizing piston 52d. Concurrently, the exhaust passage 70c is opened to atmosphere to cause the molten metal 62 having been stored in the molten metal passage 58 and the gate tip 70a to be returned to the melting furnace 60.

Figure 9:
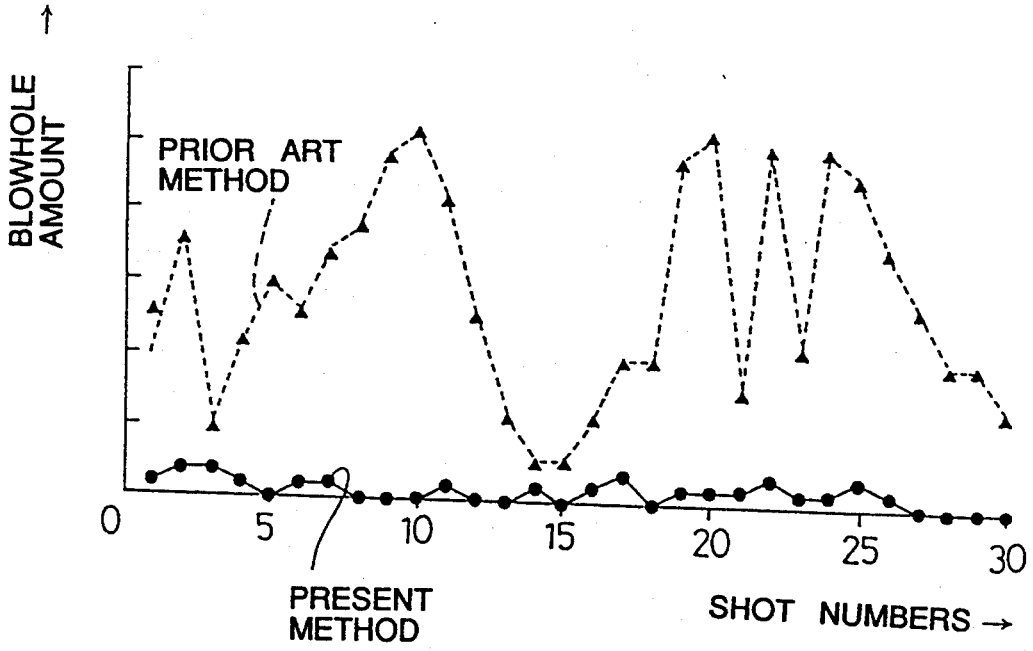
FIG. 9 is a graph comparing the status of generation of blowholes (as a result of bubbles) in the casting obtained with the casting apparatus according to the invention and that in the casting obtained with the prior art casting apparatus.

FIG. 9 is a graph comparing the status of generation of blowholes (as a result of bubbles) in the casting obtained with the casting apparatus of this embodiment and that of the casting obtained with the prior art casting apparatus. In the graph, the ordinate is taken for the amount of blowholes, and the abscissa is taken for the number of shots. The blowhole generation status was evaluated according to the area of blowhole projection thorugh X-ray photography of each casting.

As is seen from the graph, with the casting obtained with the prior art casting apparatus the blowhole amount is large and fluctuates considerably. In contrast, with the casting obtained with the casting apparatus of this embodiment the blowhole amount is small and stable. This is so becuase substantially no gas is sucked into the cavity.

A second embodiment of the invention will now be described with reference to FIGS. 10 to 15.

The second embodiment is different from the preceding first embodiment in the molten metal supply mechanism for supplying molten metal to the molten metal reservoir. More specifically, while in the first embodiment the molten metal 62 is introduced into the molten metal reservoir by the pressure reducing unit connected to the top of the gate tip 70*a*, in the second embodiment the introduction is effected by applying a pressure to the surface of the molten metal 62 stored in the melting furnace 60. In addition, the second embodiment is different from the first embodiment in the shape of the gate tip.

Figure 10:
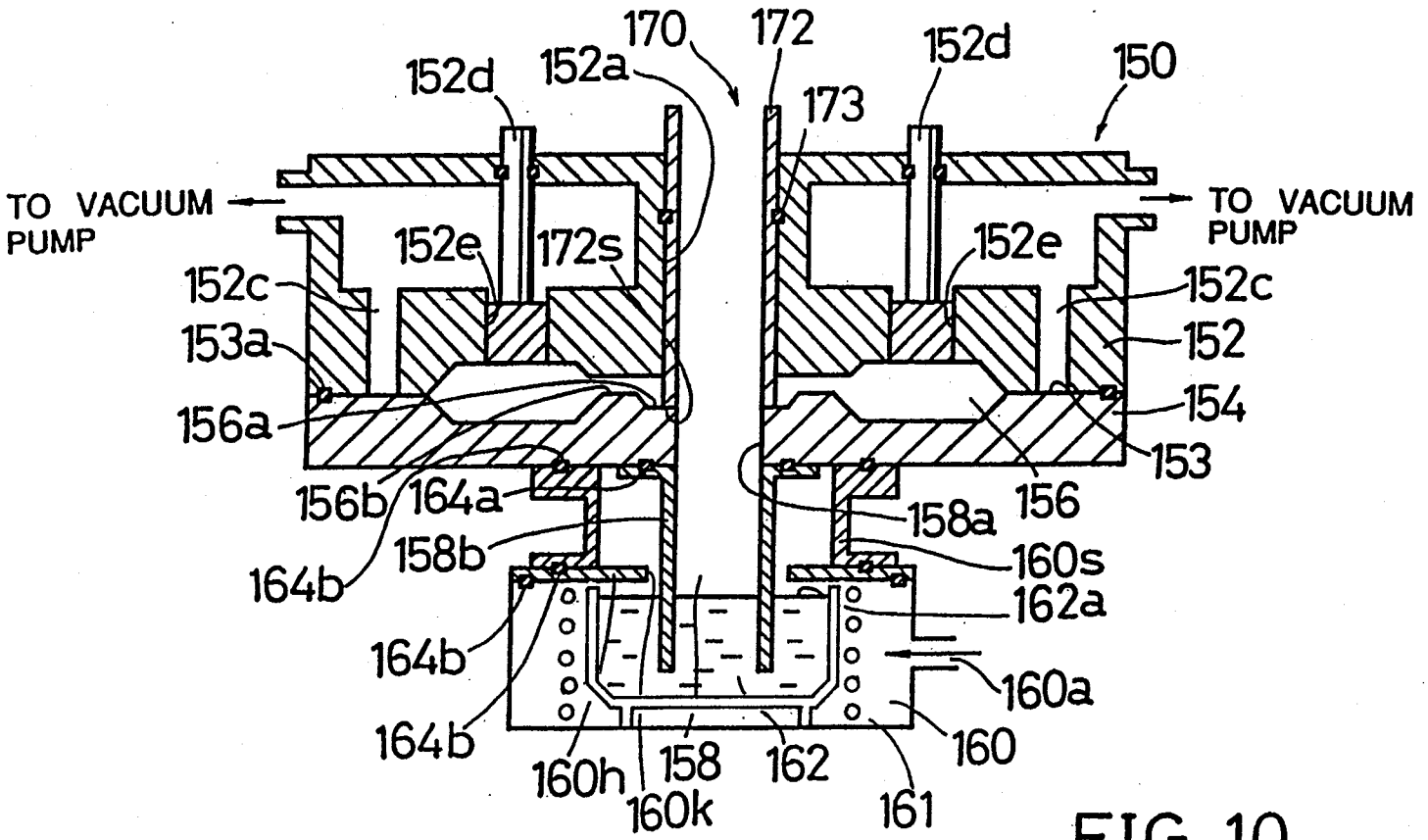
FIG. 10 is a sectional view of the essential parts of a casting apparatus according to a second embodiment of the invention.

FIG. 10 is a sectional view of the essential parts of a casting apparatus according to the second embodimnet. This casting apparatus comprises a casting die 150 including an upper die 152 and a lower die 154. In the casting die 150, a central cavity 156 is formed when the upper and lower dies 152 and 154 are engaged. The cavity 156 has a central sprue 156*a* formed via a dam portion 156*b*. At the sprue 156*a*, the cavity 156 is communicated with a molten metal passage 158.

The molten metal passage 158 is constituted by a passage 158*a* formed in the center of the lower die 154 and a cylinsdrical stalk 158*b* connected to the lower surface of the lower die 154 in such a manner as to be communicated with the passage 158*a*. During casting, the free end of the stalk 158*b* is immersed in a molten metal 162 stored in a melting furnace 160. An O-ring 164*a* made of heat-resistant rubber is provided between the engaged surfaces of the lower die 154 and the stalk 158*b* to ensure airtightness of the molten metal passage 158.

The melting furnace 160 has its top opening closed by a lid 160*h* having a central hole 160*k* which is penetrated by the stalk 158*b*. Between the lid 160*h* and the lower surface of the lower die 154, a substantially cylindrical seal member 160*s* is disposed in such a manner as to surround the stalk 158*b*. O-rings 164*b* made of heat-resistant rubber are provided for sealing between the seal member 160*s* and the lower die 154 and also between the seal member 160*s* and the lid 160*h*. A further O-ring 164*b* made of heat-resistant rubber is provided for sealing between the lid 160*h* and the melting furnace 160. With this arrangement, the interior of the melting furnace 160 is held air-tight. In FIG. 10, designated at 161 is a heater for thermally melding metal.

To the melting furnace 160 is connected a piping 160*a* which is communicated with a pressurizing unit (not shown). When pressurized gas is forced from the pressurizing unit through the piping into the melting furnace 160, a predetermined pressure is applied to the surface 162*a* of the molten metal 162 in the melting furnace 160, whereby the molten metal 162 is partly raised into the molten metal passage 158 via the stalk 158*b*. The pressure applied to the molten metal 162 is set according to the height to which molten metal is to be raised.

In the pressurizing unit, an inner pressure vent valve (not shown) is mounted in such a manner as not to apply a pressure above 0.45 kg/cm$^2$ maximum (with respect to 0 kg/cm$^2$ as atmospheric pressure) to the melting furnace 160. During casting, usually a pressure of 0.25 kg/cm$^2$ is applied, as will be described later.

A gate mechanism 170 for opening and closing the sprue 156*a* of the cavity 156 is provided at the interface between the cavity 156 and the molten metal passage 158. The gate mechanism 170 includes a cylindrical gate tip 172 and a mechanism (not shown) for axially displacing the gate tip 172. The gate tip 172 is accommodated in a central axial hole 152*a* formed in the upper die 152 such that it is substantially in close contact with the wall surface of the hole 152*a*. The gate tip 172 can be displaced vertically through the hole 152*a* when the moving mechanism is operated.

When the gate tip 172 is lowered upon operation of the moving mechanism to bring its end face 172s into contact with the surface of the lower die 154, the sprue 56*a* of the cavity 156 is closed by the outer surface of the gate tip 172. At this time, the inner space of the gate tip 172 is communicated with the molten metal passage 158, and the molten metal passage 158 is open to atmosphere.

When the gate tip 172 is raised so that its end face 172*s* is separated from the surface of the lower die 154 to open the sprue 156*a* of the cavity 156, the interior of the gate tip 172 is communicated with both the molten metal passage 158 and cavity 156.

An O-ring 173 made of heat-resistant rubber is provided between the outer surface of the gate tip 172 and the surface of the hole 152*a* of the upper die 152 to prevent deterioration of the seal due to vertical sliding of the gate tip 172.

Figure 11:
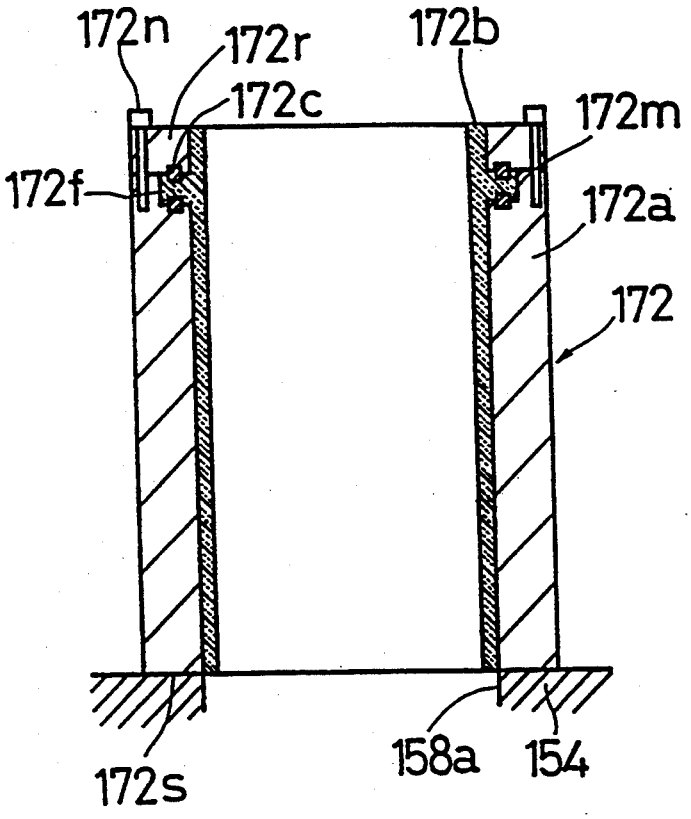
FIG. 11 is an enlarged-scale sectional view showing a gate tip used in the second embodiment of the casting apparatus.

The gate tip 172 is a cylindrical member having a height of 700 mm. As shown in FIG. 11, the gate tip 172 includes an outer cylinder 172*a* made of a metal and an inner cylinder 172*b* made of a ceramic material.

The inner cylinder 172*b* has a flange 172*f* formed adjacent its top. Its outer diameter is less than the inner diameter of the central axial passage 158*a* formed in the lower die 154. Thus, the inner cylinder 172*b* is not in contact with the lower die 154 when the end face 172*s* of the gate tip 172 is in contact with the surface of the lower die 154, and it is not readily broken although it is made of a ceramic material and fragile.

The outer cylinder 172*a* covers the inner cylinder 172*b*, and its inner diameter is made to be substantially equal to the outer diameter of the inner cylinder 172*b*. Its top surface is formed with a recess 172*m* for accommodating the flange 172*f* of the inner cylinder 172*b*. With the flange 172*f* of the inner cylinder 172*b* accommodated in the recess 172*m*, a ring-like retainer 172*r* for retaining the flange 172*f* is secured by bolts 172*n* to the top surface of the outer cylinder 172*a*.

With this arrangement, the inner cylinder 172*b* is reliably secured by the flange 172*f* to the outer cylinder 172*a*. Packing members 172*c* are provided for sealing between the flange 172*f* of the inner cylinder 172*b* and the ring-like retainer 172*r* and also between the flange 172*f* and the recess 172*m* of the outer cylinder 172*a*.

In this embodiment, the interior of the gate tip 172 serves as a molten metal reservoir.

The cavity 156 formed in the casting die 150, as shown in FIG. 10, is communicated with a pressure reduction passage 152*c* formed in the upper die 152 via a gap 153 formed between the engagement surfaces of the upper and lower dies 152 and 154. The pressure reduction passage 152*c* is connected to a vacuum pump (not shown). An O-ring 153*a* made of heat-resistant rubber is provided between the engagement surfaces of the upper and lower dies 152 and 154 adjacent the edge thereof to ensure airtightness between the cavity 156 and the outside of the casting die 150.

With this construction, when the vacuum pump is driven with sprue 156*a* held closed by the gate tip 172, the pressure in the cavity 156 is reduced to a predetermined extent (i.e., to 20 Torr (2.666×10P3 Pa) or below).

Above the cavity 156, a pressurizing piston 152*d* is provided to pressurize the molten metal 162 charged in the cavity 156. The pressurizing piston 152*d* is capable of vertically sliding along a cylinder 152*e* formed in the upper die 152, and it is operated by a piston drive mechanism (not shown). The pressure applied by the pressurizing piston 152*d* is set to 200 to 1,000 kg/cm$^2$ (1.96 $\times 10^7$ to $9.8\times 10^7$ Pa).

The operation of this casting apparatus will now be described with reference to FIGS. 12 to 15.

Figure 12:
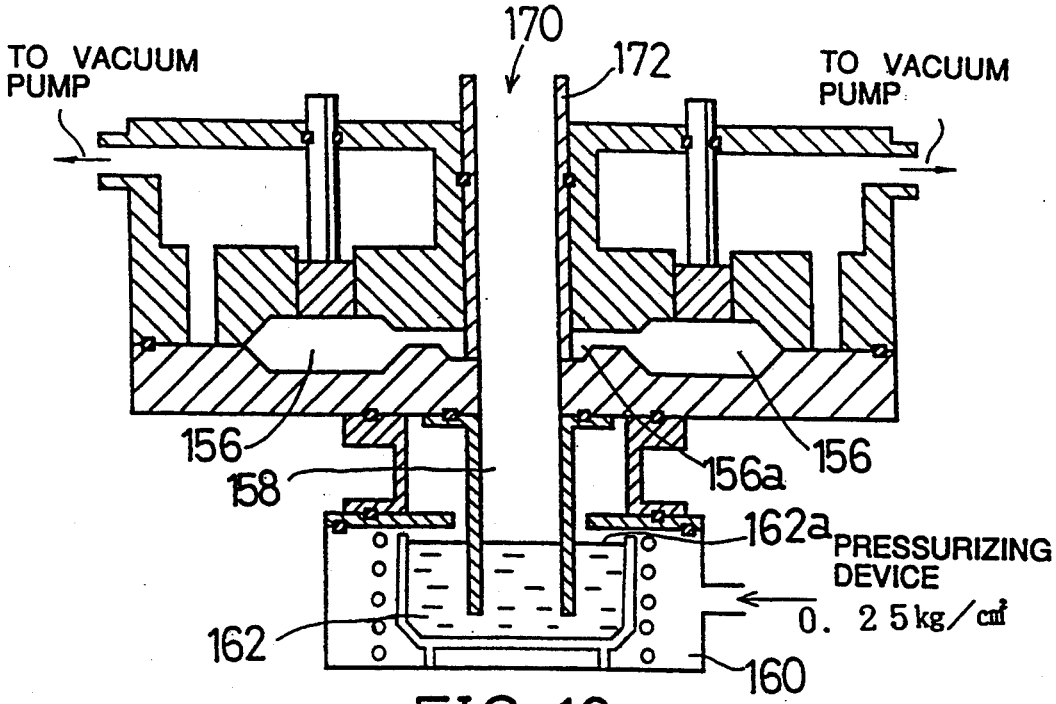
FIG. 12 is a sectional view illustrating the operation of the casting apparatus of the second embodiment.
Figure 13:
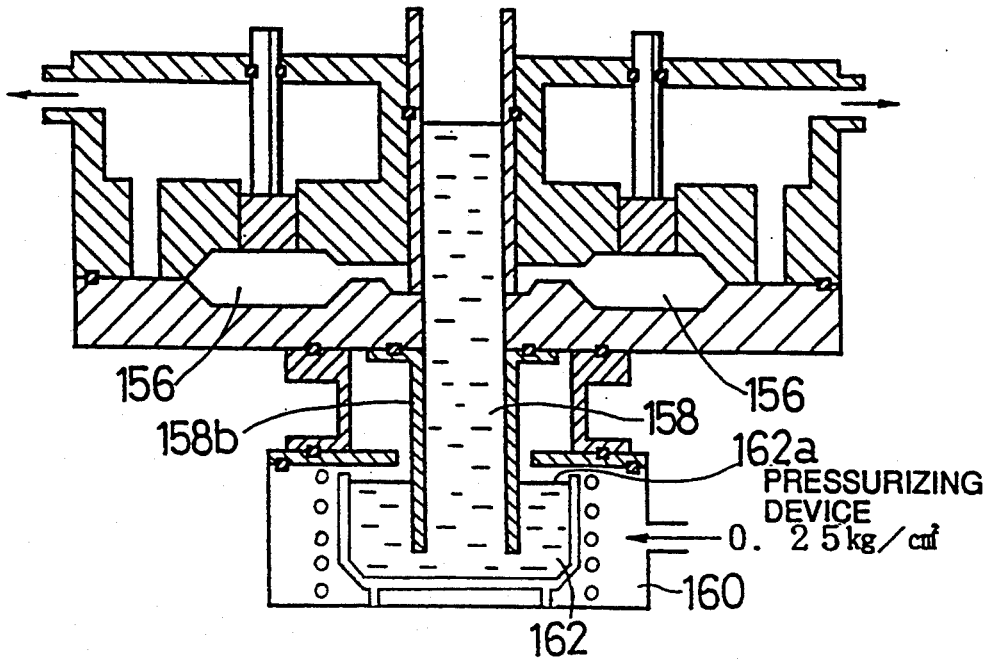
FIG. 13 is a sectionial view illustrating the operation of the casting apparatus of the second embodiment.
Figure 14:
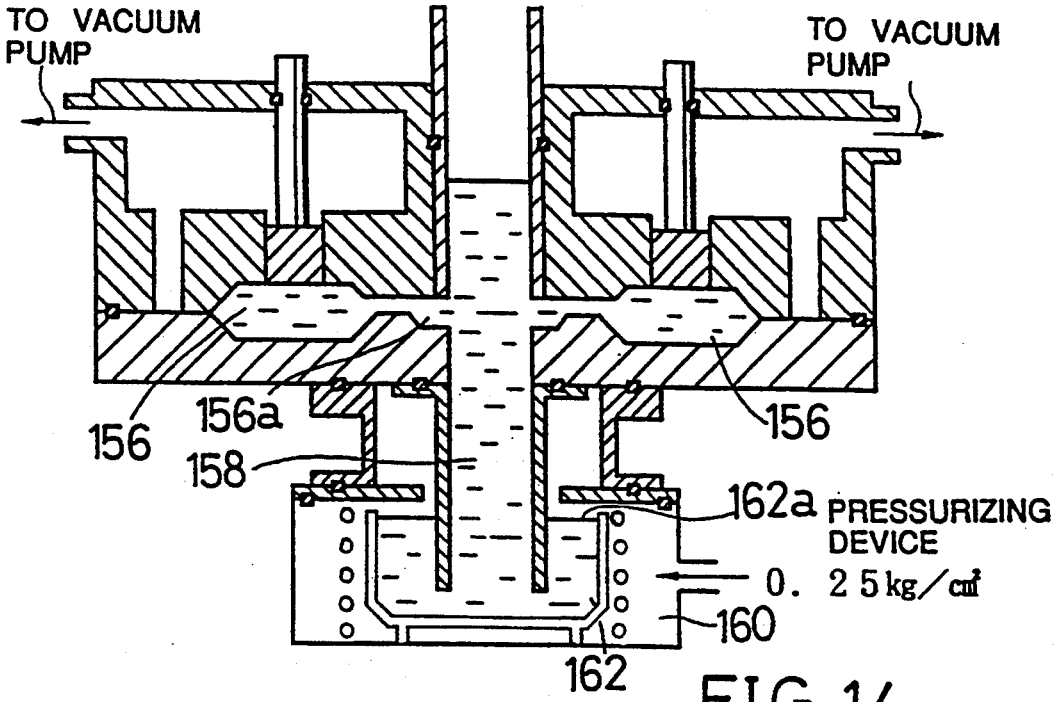
FIG. 14 is a sectional view illustrating the operation of the casting apparatus of the second embodiment.

First, as shown in FIG. 12, with the sprue 156*a* held closed by the gate mechanism 170, the pressure in the cavity 156 is reduced by the vacuum pump. Also, a pressure of about 0.25 kg/cm$^2$ is applied to the surface 162*a* of the molten metal 162 in the melting furnace 160 with the supply of pressurized gas from the pressurizing unit to the melting furnace 160, thus causing the molten metal 162 to be raised into the gate tip 172 via the stalk 158*b*, as shown in FIG. 13. When a pressure of 0.25 kg/cm$^2$ is applied to the melting furnace 160, the surface of the molten metal in the gate tip 172 is raised to a height of about 250 mm from the surface of the lower die 154 (i.e., parting surface). With the molten metal surface at the height of 250 mm from the surface of the lower die 154, the molten metal 162 in excess of the amount to be charged into the cavity is stored in a portion of the gate tip 172 higher in level than the the upper end level of the sprue 156*a* of the cavity 156. If a pressure of 0.45 kg/cm$^2$ (i.e., maximum pressure) is applied, the molten metal surface is raised to a height of 450 mm from the surface of the lower die 154. However, since the gate tip 172 has a height of 700 mm as noted above, the molten metal 162 does not overflow from the top of the gate tip 172 even when the maximum pressure is applied to the melting furnace 160.

When the molten metal 162 is supplied to the gate tip 172 up to a predetermined level while the pressure in the cavity 156 is reduced to a predetermined extent, the gate tip 172 is raised to open the sprue 156*a* of the cavity 156. Thus, the molten metal 162 stored in the molten metal passage 158 and gate tip 172 is sucked quickly into the cavity 156.

As the molten metal 162 in the molten metal passage 158 and the gate tip 172 is sucked into the cavity 156, the molten metal surface in the gate tip 172 is lowered. However, the molten metal 162 in excess of the amount to be charged into the cavity 156 has been stored in a portion of the gate tip 172 higher in level than the sprue 156*a* of the cavity 156. Thus, with the supply of part of the molten metal stored in the gate tip 172 to the cavity 156, the level of the molten metal surface in the gate tip 172 does not become lower than the sprue 156*a* of the cavity 156. That is, gas present or foreign matter floating atop the molten metal surface in the gate tip 172 is not sucked into the cavity 156. In this case, the space in the gate tip 172 over the molten metal surface serves as the accommodation space for accommodating the gas or foreign matter. It will be seen that the accommodation space need not be isolated from atmosphere.

Figure 15:
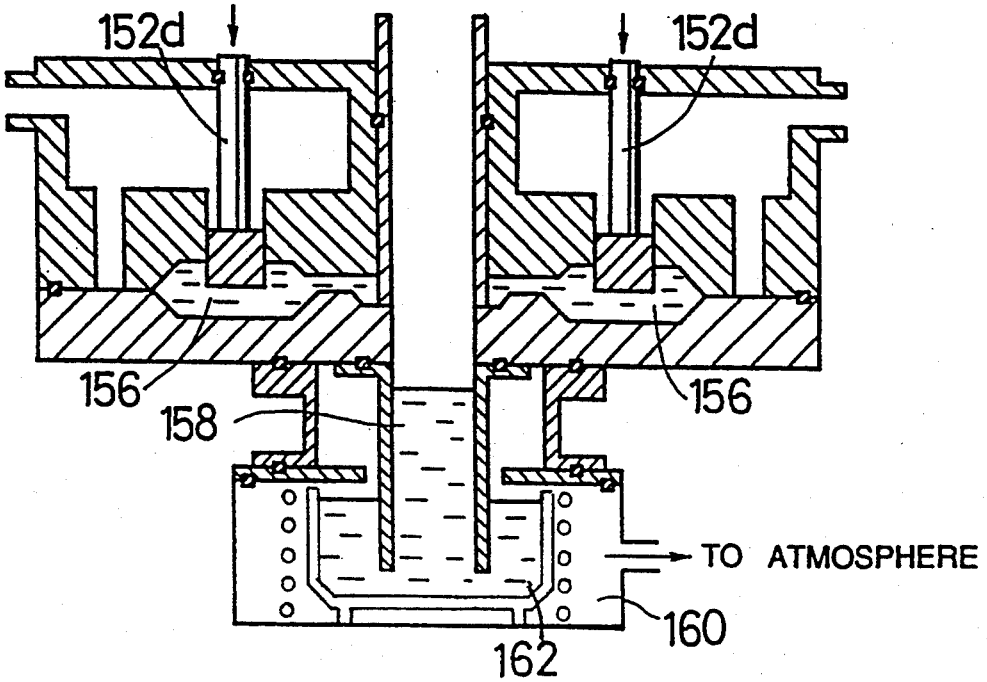
FIG. 15 is a sectional view illustrating the operation of the casting apparatus of the second embodiment.

When the molten metal 162 has been charged into the cavity 156 in the above way, the gate piston 172 is lowered again to close the sprue 156*a* of the cavity 156 as shown in FIG. 15. Then, the molten metal 162 in the cavity 156 is pressurized with a predetermined pressure applied by the pressurizing piston 152*d*. Concurrently, the interior of the melting furnace 160 is opened to atmosphere, whereby the molten metal 162 having been stored in the molten metal passage 158 and the molten metal reservoir 180 is returned to the melting furnace 160.

As has been shown, in this embodiment the gate tip 172 (i.e., molten metal reservoir) has sufficient volume and height, and thus compared to the previous first embodiment the control of the position of the molten metal surface in the gate tip 172 may be rough, and also the construction of the mechanism for supplying molten metal 162 to the molten metal reservoir may be simplified. Further, the gate tip 172 may be simplified in construction and thus reduced in cost. Further, the gate tip 172 may be replaced simply because it can be taken out from above the upper die 152.

A third embodiment of the invention will now be described with reference to FIGS. 16 and 17.

Figure 16:
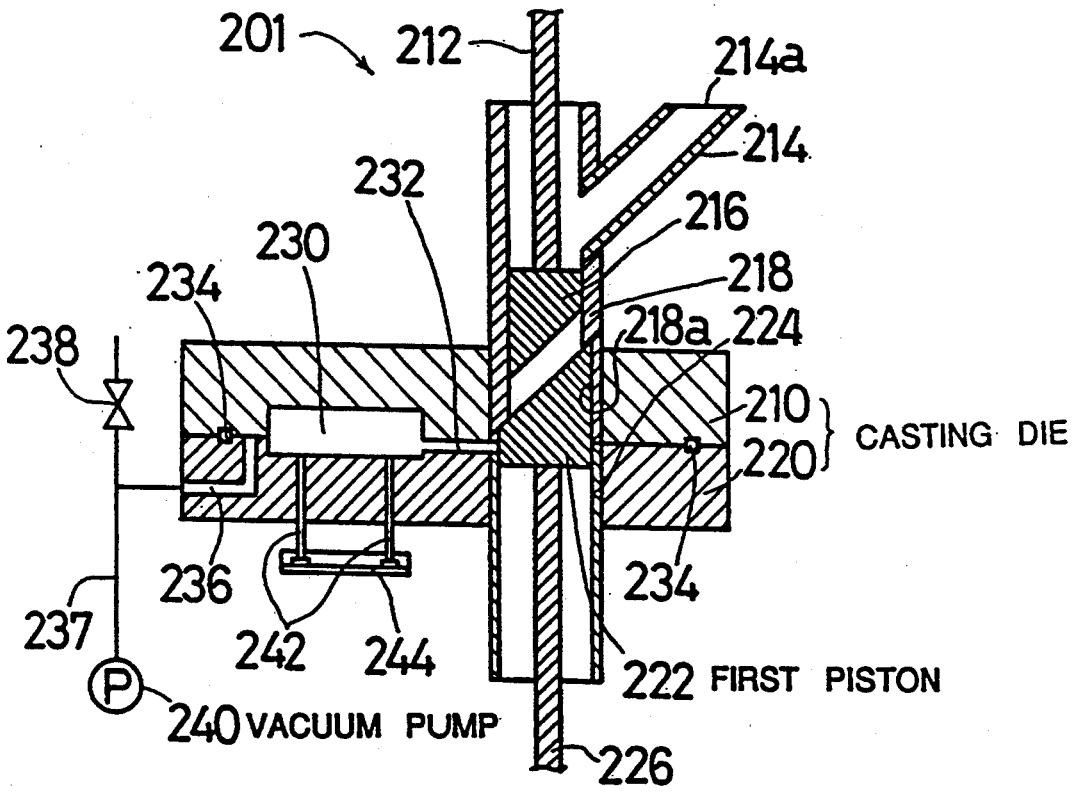
FIG. 16 is a sectional view of the essential parts of a casting apparatus according to a third embodiment of the invention.

Referring to FIG. 16, designated at 201 is a vacuum casting apparatus. This casting apparatus 201 has a construction centered on a casting die including an upper die 210 and a lower die 220.

A cavity 230 having a shape corresponding to the outer shape of a casting to be produced is formed in the upper and lower dies 210 and 220. The cavity 230 is provided with a pressure reduction port 236 which is open to the gap between the engagement surfaces of the upper and lower dies 210 and 220. The pressure reduction port 236 is connected to a vacuum pump 240 via a vacuum duct 237. By operating the vacuum pump 240, the cavity 230 can be evacuated through the vacuum duct 237, pressure reduction port 236 and the gap between the engagement surfaces of the upper and lower dies 210 and 220.

On an intermediate portion of the vacuum duct 237 is provided a leak valve 238 for restoring normal pressure in the vacuum duct 237.

The lower die 220 has a plurality of push pins 242 and a push plate 244 for raising together these push pins 242. The free end of these push pins 242 extends into the cavity 230, and when the push plate 244 is raised by an actuator (not shown), the cast product in the cavity 230 is raised by the push pins 242.

An O-ring 234 for gas-tight sealing is provided between the engagement surfaces of the upper and lower dies 210 and 220 in such a manner as to surround the cavity 230, thus preventing external air outside the dies 210 and 220 from entering the cavity 230.

Near the cavity 230, an upper die cylinder 218 and a lower die cylinder 224 are secured to the upper and lower dies 210 and 220, respectively. When the upper and lower dies 210 and 220 are engaged, the upper and lower die cylinders 218 and 224 form a space having a rectangular sectional profile and vertically penetrating the dies 210 and 220. The lower die 210 is formed with a sprue 232 which communicates the cavity 230 with the lower die cylinder 224.

In the lower die cylinder 224, a gate piston (first piston) 222 having a shape obtained by obliquely cutting a quadrangular pillar is slidably fitted. A gate piston shaft 226 is secured to the gate piston 222. The gate piston 222 is moved back and forth (i.e., in vertical directions) with axial movement of the gate piston shaft 226 caused by operating an actuator (not shown).

With the advancement (i.e., raising) of the gate piston 222, the sprue 232 is closed. With the retreat (i.e., lowering) of the gate piston 222, the sprue 232 is opened.

The upper die cylinder 218, as shown in FIG. 16, has a construction such that its inner surface diameter is changed intermediately. The inner surface 218*a* of the upper die cylinder 218 in contact with the lower die cylinder 224 has an increased inner diameter such that a head portion of the gate piston 222, having a shape obtained by obliquely cutting a quadrangular pillar, is fitted. This step of the inner surface of the upper die cylinder 218 has a role of positioning the upper set end of the gate piston 222.

In the upper die cylinder 218 is slidably fitted a plunger piston (second piston) 216, which has an outer diameter capable of being fitted in a reduced inner diameter top portion of the upper die cylinder 218. The plunger piston 216 also has a shape obtained by obliquely cutting a quadrangular pillar, and its free end face is adapted to be in close contact with the free end face of the gate piston 222.

A plunger piston shaft 212 is secured to the plunger piston 216, and the plunger piston 216 is advanced and retreated (i.e., moved vertically) with axial movement of the plunger piston shaft 212 caused by operating an actuator (not shown).

At an intermediate position of the stroke of the plunger piston 216, a branch passage 214 branching from the upper die cylinder 218 is provided. The branch passage 214 serves as a sprue and also as an opening for discharging gas or foreign matter as will be described later. With the advancement (i.e., lowering) of the plunger piston 216, the sprue 214 is closed. With the retreat (i.e., raising) of the plunger piston 216, the sprue 214 is opened.

The gate and plunger pistons 222 and 216 have shapes and dispositions such that their oblique end surfaces are substantially parallel with the inclination of the sprue 214.

The upper die and lower die cylinders 218 and 224 form a molten metal reservoir, in which molten metal is stored tentatively, and the sprue 214 communicates the molten metal reservoir with a molten metal source (not shown).

The gate piston 222 is slidably fitted in the cylinders 218 and 224 and serves as a first piston for closing the sprue 232 when advanced and for opening the sprue 232 when retreated.

The plunger piston 216 is slidably fitted in the cylinders 218 and 224 such that it faces the first piston 222, and it serves as a second piston for closing the sprue 214 when it is advanced toward the first piston 222 and for opening the sprue 214 when retreated away from the first piston 222.

The method of casting with the vacuum casting apparatus 201 having the above construction will now be described with reference to FIG. 17.

Figure 17A:
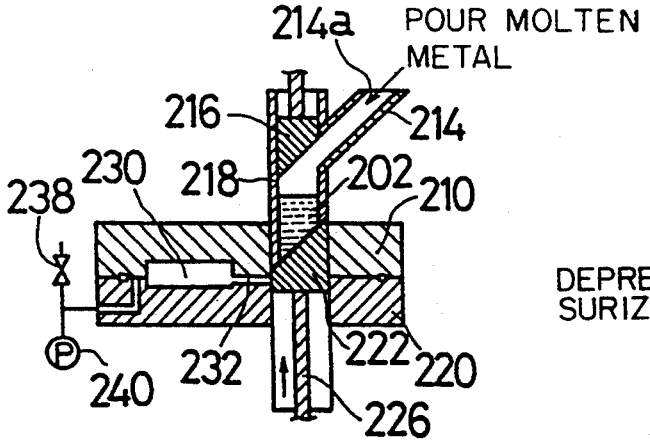
FIGS. 17(A) to 17(E) are fragmentary sectional views illustrating the operation of the third embodiment of the casting apparatus.
Figure 17B:
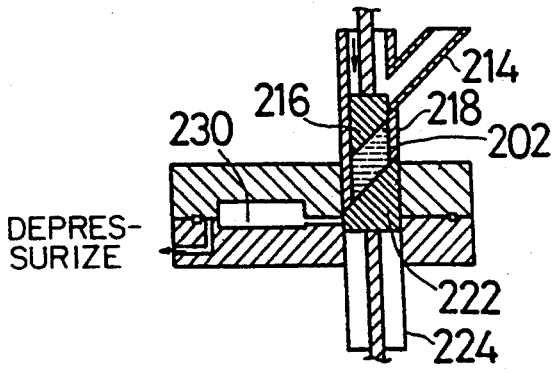
Figure 17C:
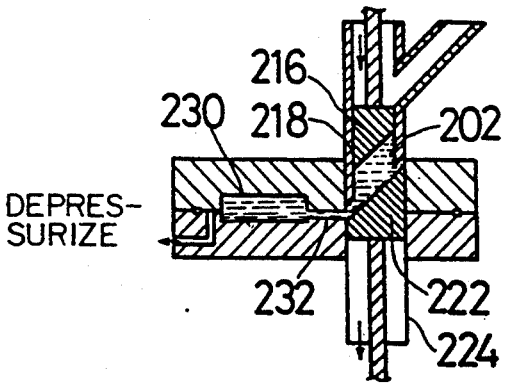
Figure 17D:
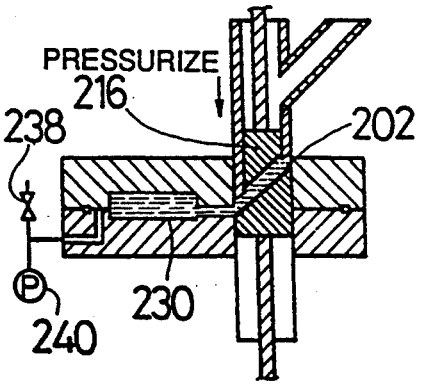
Figure 17E:
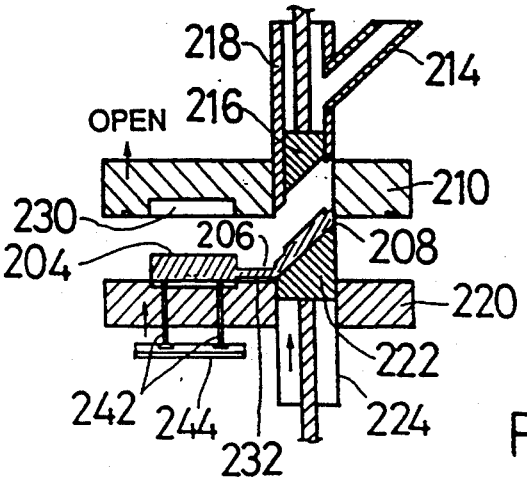
Figure 18:
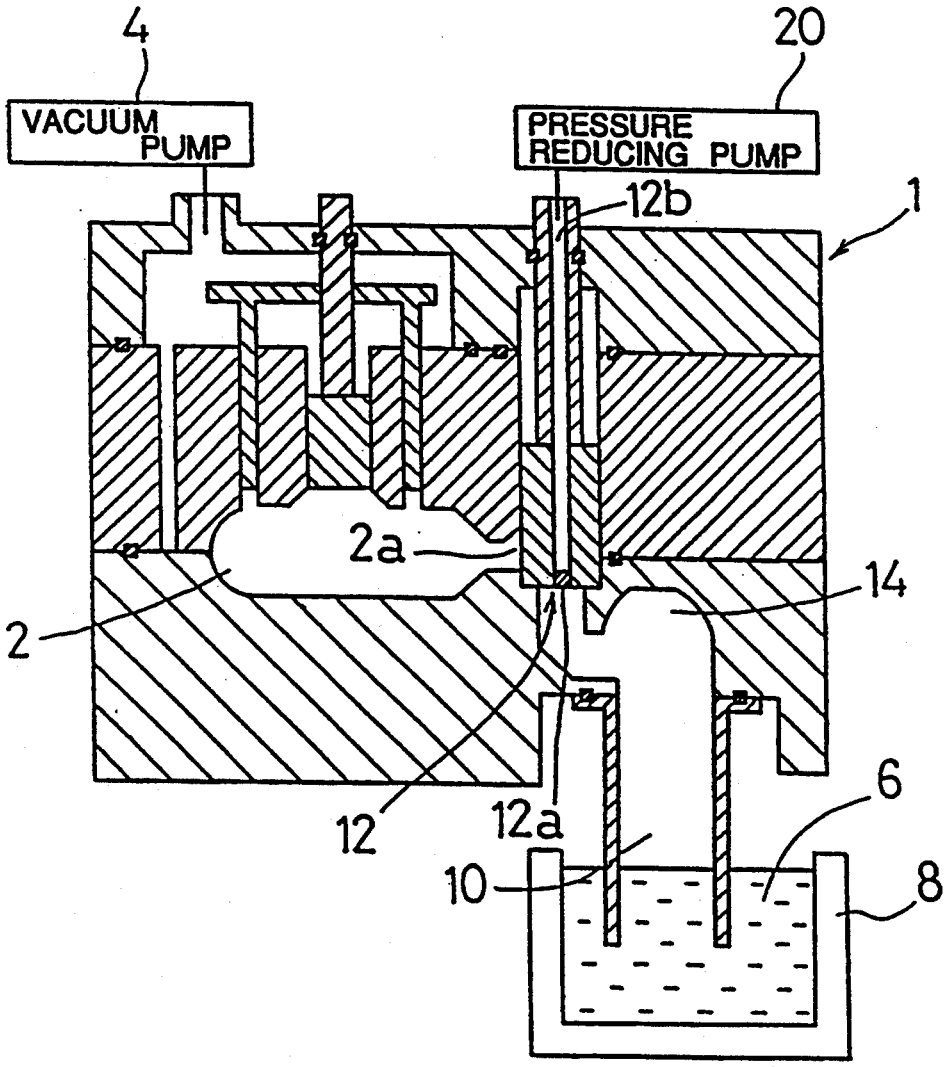
FIG.18 (PRIOR ART)
FIG. 18 is a sectional view of a prior art casting apparatus.

When a cast product obtained by the previous casting operation is taken out, the upper die 210 is spaced apart and located above the lower die 220, as shown in FIG. 17(E). The gate piston 222 has kicked out the solidified cast material and retreated (lowered), and the sprue 232 is opened to communicate the cavity 230 with the upper die and lower die cylinders 218 and 224. Meanwhile, the plunger piston 216 is at its advanced (lowered) position, and the sprue 214 which can communicate the upper die and lower die cylinders 218 and 224 with the external molten metal source is held closed by the plunger piston 216.

From this state, the upper die 210 is driven by a die drive mechanism (not shown) to be lowered into engagement with the lower die 220. Then, with the operation of actuator (not shown), the gate piston shaft 226 is raised and the gate piston 222 is advanced (raised) to close the sprue 232, as shown in FIG. 17(A). The gate piston 222 is raised up to a position corresponding to the step in the inner surface of the upper die cylinder 218. Subsequently, the vacuum pump 240 communicating with the cavity 230 is operated to evacuate the cavity 230.

Meanwhile, with the operation of an actuator (not shown), the plunger piston 216 is retreated (i.e., raised) away from the gate piston 222 to open the sprue 214. In this state, molten metal 202 is poured into the sprue 214 from a pouring opening 214*a* to be supplied to the space in the upper die cylinder 218 between the plunger and gate pistons 216 and 222.

Then, the plunger piston 216 is advanced (i.e., lowered) toward the gate piston 222, as shown in FIG. 17(B), to pressurize the molten metal 202 and air in the space between the gate and plunger pistons 222 and 216. Thus, air remaining between the upper die and lower die cylinders 218 and 224 is pushed by the plunger piston 216 to be dischaged through between the plunger piston 216 and the sprue 214 toward the pouring opening 214*a*. With continual descent of the plunger piston 216, the discharging of the residual air is completed, while the sprue 214 is closed.

During this operation, the evacuation of the cavity 230 by the vacuum pump 240 is executed.

Since the end surfaces of the plunger and gate pistons 216 and 222 are substantially parallel to the inclination of the sprue 214, the discharging of the residual air, gas, foreign matter, etc. by the urging force of the plunger piston 216 is obtained more effectively. The amount of molten metal 202 supplied from the sprue 214 in FIG. 17(A), is adjsuted in such a manner as to substantially fill the space between the plunger and gate pistons 216 and 222 formed at the time when the sprue 214 is closed by the plunger piston 216.

Then, as shown in FIG. 17(C), the plunger piston 216 is further lowered, and the gate piston 222 is lowered to open the sprue 232, causing the pressurized molten metal 202 to be supplied to the cavity 230 via the sprue 232 for casting.

During this casting, the molten metal 202 can be pressurized continuously by the plunger piston 216. It is thus possible to eliminate casting defects due to shrinkage of the casting by cooling. When the casting is solidified by cooling after the casting, the vacuum pump 240 is stopped, and the leak valve 238 is opened to restore the normal pressure in the cavity 230.

Then, as shown in FIG. 17(E), the upper die 210 is separated from the lower die 220 and raised by the die drive mechanism (not shown). Then, with the operation of a take-out actuator (not shown), the push plate 244 is raised to raise with a cast product 204 in the cavity 230 with the push pins 242. At the same time, the gate piston 222 is raised by the same stroke as the push plate 244, whereby the cast material 208 solidified in the upper die cylinder 218 is raised together with the cast material portion 206 at the sprue 232.

After the cast product 204 has been taken out, the push pins 242, push plate 244 and gate piston 222 are restored to their positions before the take-out.

In the above way, the sequence of casting operations is completed.

As has been described, with the above embodiment, molten metal is charged into the evacuated cavity 230 after the gas or foreign matter floating on the molten metal has been removed. Thus, there is no possibility of trapping of air in the molten metal, and it is possible to reliably prevent generation of casting defects such as blowholes and microporocity.

While in the above embodiment, the gate and plunger pistons having a shape obtained by obliquely cutting a quadrangular pillar are used as the first and second pistons, it is possible to use pistons having other shapes as well. It is also possible to provide a vertically invers disposition of the first and second pistons and associated sprues, and further provide a corresponding horizontal dispsition of these parts.

Further, while in the above embodiment, the upper die and lower die cylinders have different inner diameters, it is possible to set the same inner diameter. Further, the O-ring provided for gas-tight sealing between the engagement surfaces of the upper and lower dies is not essential.

Further, the shapes, sizes, materials, dispositions, etc. of other parts of the vacuum casting apparatus are by no means limitative.

As a further effect peculiar to the above embodiment, since the end surfaces of the plunger and gate pistons 216 and 222 are parallel to each other and also substantially parallel to the inclination of the sprue 214, it is possible to obtain effective discharging of gas or foreign matter with the urging force of the plunger piston 216. Further, it is possible to facilitate the purging of air from molten metal by disposing the molten metal cylinders (i.e., upper die and lower die cylinders 218 and 224) in vertical direction and directing the sprue 214 obliquely upward.

We claim:

1. A vacuum casting apparatus comprising a cavity formed inside a casting die, pressure reducing means for reducing the pressure of the cavity, a molten metal passage capable of being communicated with and leading molten metal to the cavity, gate means for on-off switching the communication between the cavity and the molten metal passage, and a molten metal reservoir for temporarily storing the molten metal to be sucked into the cavity, characterized in that:

said molten metal reservoir is formed by making the volume of a portion of said molten metal passage higher in level than the level of said gate means to be greater than the volume of said cavity so that gas and foreign matter floating atop the molten metal stored in said molten metal reservoir does not enter said cavity even when a major portion of the molten metal stored in said molten metal reservoir is sucked into said cavity.

2. The vacuum casting apparatus as defined in claim 1, wherein said molten metal reservoir is constituted by a cylinder open at an upper end, said cylinder also serving as said gate means.

3. The vacuum casting apparatus as defined in claim 1, wherein:

said molten metal passage is constituted by a cylinder;

a first piston and a second piston are slidably accommodated in said cylinder;

said first piston constitutes said gate means;

said molten metal reservoir is formed as a space between said first piston and said second piston when the communication between said cavity and said molten metal passage is cut off by said first piston;

a branch passage branching from said cylinder is formed on the way of a stroke of said second piston;

said second piston has a piston end surface slanted toward said branch passage;

said gas and foreign matter floating atop the molten metal are brought out along said slanted surface into said branch passage during a stroke of said second piston; and the communication between said branch passage and said molten metal reservoir is blocked at the stroke end of said second piston.

4. A method of vacuum casting molten metal comprising the steps of:

bringing gas and foreign matter floating atop molten metal stored in a molten metal reservoir into a passage branching from the reservoir while the molten metal remains in the reservoir;

cutting off communication between the passage and the reservoir; and sucking the molten metal from the reservoir into a cavity held under a reduced pressure by opening a gate which controls the communication between the molten metal reservoir and the cavity.

* * * * *

US005423369B1

REEXAMINATION CERTIFICATE (3222nd)

United States Patent [19] [11] B1 5,423,369

Ota et al. [45] Certificate Issued Jun. 10, 1997

[54] APPARATUS FOR AND METHOD OF VACUUM CASTING

[75] Inventors: Atsushi Ota, Toyota; Minoru Uozumi; Shigeki Tamura, both of Aichi; Hirokazu Onishi, Toyota; Yasuyuki Arakawa, Nagoya, all of Japan

[73] Assignee: Toyota Jidosha Kabushiki Kaisha, Toyota, Japan

Reexamination Request:
No. 90/004,417, Oct. 18, 1996

Reexamination Certificate for:

| | |
|---|---|
| Patent No.: | **5,423,369** |
| Issued: | **Jun. 13, 1995** |
| Appl. No.: | **75,555** |
| Filed: | **Oct. 26, 1992** |

[22] PCT Filed: Oct. 26, 1992

[86] PCT No.: PCT/JP92/01387

§ 371 Date: Jun. 24, 1993

§ 102(e) Date: Jun. 24, 1993

[87] PCT Pub. No.: WO/9307977

PCT Pub. Date: Apr. 29, 1993

[30] Foreign Application Priority Data

| | | | |
|---|---|---|---|
| Oct. 25, 1991 | [JP] | Japan | 3-306999 |
| Oct. 30, 1991 | [JP] | Japan | 3-311674 |

[51] Int. Cl.[6] ..... B22D 17/12; B22D 18/02; B22D 18/06

[52] U.S. Cl. ..... 164/63; 164/119; 164/120; 164/254; 164/306

[58] Field of Search ..... 164/63, 119, 120, 164/254, 306, 309

[56] References Cited

U.S. PATENT DOCUMENTS 4,505,318 3/1985 Tokui et al. .

FOREIGN PATENT DOCUMENTS

| | | |
|---|---|---|
| 0 065 841 | 12/1982 | European Pat. Off. . |
| 54-133430 | 10/1979 | Japan . |
| 56-6769 | 1/1981 | Japan . |
| 56-121069 | 8/1981 | Japan . |
| 59-9263 | 3/1984 | Japan . |
| 2-155557 | 6/1990 | Japan . |
| 3-68955 | 7/1991 | Japan . |

*Primary Examiner*—J. Reed Batten, Jr.

[57] ABSTRACT

In a method of vacuum casting molten metal sucked from a molten metal reservoir into a cavity held under a reduced pressure by opening a gate having been blocking the communication between the molten metal reservoir and the cavity, the trapping of gas and foreign matter in the cavity is effectively prevented. To this end, an accommodation space for accommodating gas and foreign matter is provided in the molten metal reservoir. The accommodation space is provided at a position from which the accommodated matter is not sucked into the cavity.

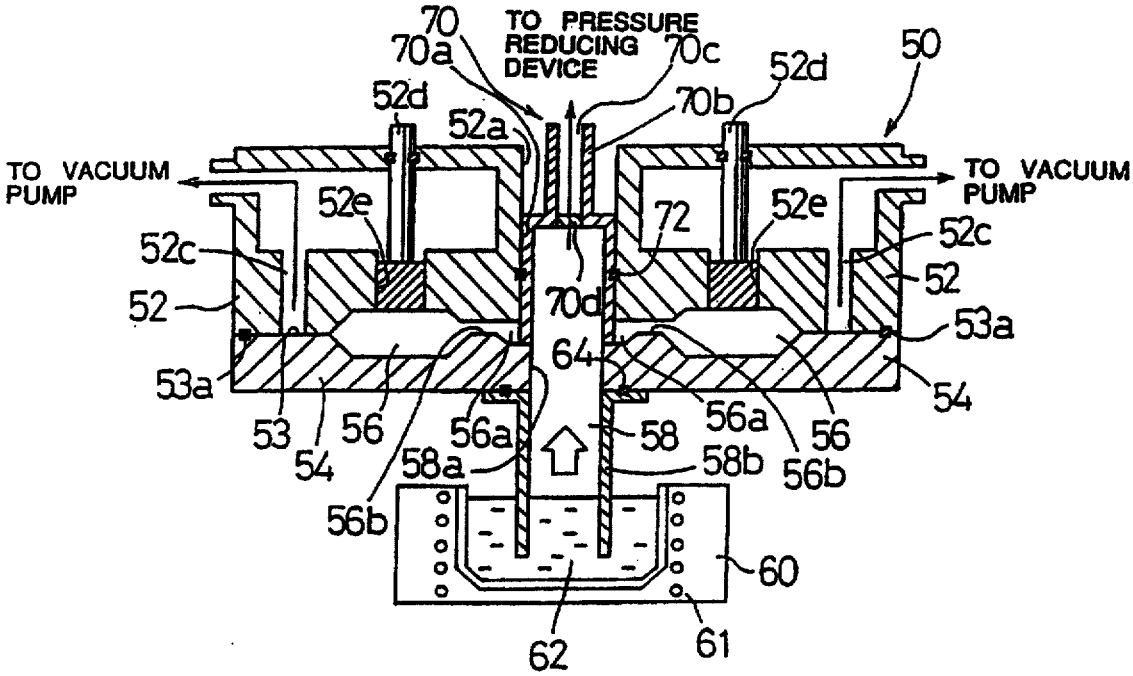

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 4 is confirmed.

Claim 3 is cancelled.

Claim 1 is determined to be patentable as amended.

Claim 2, dependent on an amended claim, is determined to be patentable.

New claims 5 and 6 are added and determined to be patentable.

1. A vacuum casting apparatus comprising*:* a cavity formed inside a casting die, pressure reducing means for reducing the pressure of the cavity, a molten metal passage capable of being communicated with *both the cavity and a molten metal tank* and leading molten metal *in the metal tank* to the cavity, gate means for on-off switching the communication between the cavity and the molten metal passage, and a molten metal reservoir for temporarily storing the molten metal to be sucked into the cavity[, characterized in that:]*;*

*wherein* said molten metal reservoir is formed by making the volume of a portion of said molten metal passage higher in level than the level of said gate means to be greater than the volume of said cavity so that gas and foreign matter floating atop the molten metal stored in said molten metal reservoir does not enter said cavity even when a major portion of the molten metal stored in said molten metal reservoir is sucked into said cavity[.]*;*

*wherein said molten metal reservoir includes means for discharging gas, provided at a level higher than the level of a surface of the molten metal temporarily stored in said molten metal reservoir; and*

*wherein said molten metal reservoir extends vertically so that the gas is not trapped during introduction of the molten metal into said molten metal reservoir.*

*5. A vacuum casting apparatus comprising: a cavity formed inside a casting die, pressure reducing means for reducing the pressure of the cavity, a molten metal passage capable of being communicated with and leading molten metal to the cavity, gate means for on-off switching the communication between the cavity and the molten metal passage, and a molten metal reservoir for temporarily storing the molten metal to be sucked into the cavity;*

*wherein said molten metal reservoir is formed by making the volume of a portion of said molten metal passage higher in level than the level of said gate means to be greater than the volume of said cavity so that gas and foreign matter floating atop the molten metal stored in said molten metal reservoir does not enter said cavity even when a major portion of the molten metal in said molten metal reservoir is sucked into said cavity; and*

*wherein said molten metal reservoir comprises a cylinder open at an upper end, said cylinder also serving as said gate means.*

*6. A vacuum casting apparatus comprising a cavity formed inside a casting die, pressure reducing means for reducing the pressure of the cavity, a molten metal passage capable of being communicated with and leading molten metal to the cavity, gate means for on-off switching the communication between the cavity and the molten metal passage, and a molten metal reservoir for temporarily storing the molten metal to be sucked into the cavity;*

*wherein said molten metal reservoir is formed by making the volume of a portion of said molten metal passage higher in level than the level of said gate means to be greater than the volume of said cavity so that gas and foreign matter floating atop the molten metal stored in said molten metal reservoir does not enter said cavity even when a major portion of the molten metal stored in said molten metal reservoir is sucked into said cavity;*

*wherein said molten metal passage is constituted by a cylinder;*

*a first piston and a second piston are slidably accommodated in said cylinder;*

*said first piston constitutes said gate means;*

*said molten metal reservoir is formed as a space between said first piston and said second piston when the communication between said cavity and said molten metal passage is cut off by said first piston;*

*a branch passage branching from said cylinder is formed on the way of a stroke of said second piston;*

*said second piston has a piston end surface slanted toward said branch passage;*

*said gas and foreign matter floating atop the molten metal are brought out along said slanted surface into said branch passage during a stroke of said second piston; and*

*the communication between said branch passage and said molten metal reservoir is blocked at the stroke end of said second piston.*

* * * * *